United States Patent [19]

Pellegri

[11] Patent Number: 4,668,370

[45] Date of Patent: May 26, 1987

[54] ELECTRODE FOR ELECTROCHEMICAL PROCESSES AND USE THEREOF IN ELECTROLYSIS CELLS

[75] Inventor: Alberto Pellegri, Luino, Italy

[73] Assignee: Oronzio de Nora Implanti Elettrochimici S.p.A., Milan, Italy

[21] Appl. No.: 791,266

[22] Filed: Oct. 25, 1985

[30] Foreign Application Priority Data

Nov. 7, 1984 [IT] Italy ..... 83633 A/84

[51] Int. Cl.[4] ..... C25B 1/46; C25B 11/08

[52] U.S. Cl. ..... 204/252; 204/98; 204/128; 204/290 R; 204/292

[58] Field of Search ..... 204/98, 128, 252, 290 R–293

[56] References Cited

U.S. PATENT DOCUMENTS

| | | | |
|---|---|---|---|
| 3,284,333 | 11/1966 | Parsi et al. | 204/292 |
| 3,294,667 | 12/1966 | Giuffrida | 204/292 |
| 4,157,943 | 6/1979 | Scarpellino, Jr. et al. | 204/292 |
| 4,272,354 | 6/1981 | de Nora et al. | 204/292 |
| 4,290,859 | 9/1981 | Oda et al. | 204/292 |
| 4,392,927 | 7/1983 | Fabian et al. | 204/292 |
| 4,421,626 | 12/1983 | Stachurski et al. | 204/290 R |
| 4,455,211 | 6/1984 | Ray et al. | 204/292 |
| 4,470,893 | 9/1984 | Oda et al. | 204/292 |
| 4,496,453 | 1/1985 | Yoshida et al. | 204/292 |
| 4,498,962 | 2/1985 | Oda et al. | 204/292 |

FOREIGN PATENT DOCUMENTS

| | | | |
|---|---|---|---|
| 0004808 | 10/1979 | European Pat. Off. | 204/290 R |
| 0079771 | 7/1978 | Japan | 204/292 |
| 2085031 | 4/1982 | United Kingdom | 204/292 |

*Primary Examiner*—Terryence Chapman

*Attorney, Agent, or Firm*—Pollock, Vande Sande & Priddy

[57] ABSTRACT

The present invention provides an electrode having a coating made of electrocatalytic ceramic materials on substantially incompatible metal substrates, by resorting to the use of an anchoring pre-coating or interlayer, applied over the metal substrate advantageously by galvanic electrodeposition, said pre-coating generally consisting of an inert metallic matrix containing particles of a ceramic material which preferably is compatible or even isomorphous with respect to the ceramic material constituting the superficial or external electrocatalytic coating.

Adhesion to the metal substrate and electrical conductivity through the coating result thereby greatly improved.

Further, the electrolysis of sodium chloride in cells provided with the electrode of the present invention is more efficient and less problematic.

10 Claims, No Drawings

ELECTRODE FOR ELECTROCHEMICAL PROCESSES AND USE THEREOF IN ELECTROLYSIS CELLS

DESCRIPTION OF THE INVENTION

The present invention generally concerns electrodes for use in electrochemical reactions, in particular composite catalytic electrodes. The electrodes comprise a highly conductive support and a coating of a different catalytic material with respect to the material constituting the support.

Particularly, the invention concerns an improved electrode, the process for making the same and the use of said electrode in electrolytic cells, especially for the electrolysis of alkali metal halides and more particularly of sodium chloride.

The importance connected with the availability of efficient and durable electrodes may be easily appraised considering that, for example, millions of tons of chlorine and caustic soda are produced every year, mainly by electrolysis of aqueous solutions of sodium chloride, in order to meet the demand on the market. A reduction of just 50 millivolts in the cell voltage results into very significant savings in power consumption, for producing the same quantity of chlorine and caustic soda.

In the electrolysis of sodium chloride, as in other electrolytic processes, a significant contribution to the cell voltage is due to the overvoltages of the electrodes. The overvoltage, the other conditions being those characteristic of the particular electrolytic process, depends essentially upon the electrode surface. That is, it depends upon the chemical-physical nature of the superficial material whereat the electrochemical reaction takes place as well as upon other factors, such as the crystallographic characteristics of the superficial material, and the smoothness or roughness of said material.

Many ceramic materials have industrially interesting electrocatalytic properties. For instance, oxides, mixed oxides, composite oxides, or other electroconductive compounds of a metal and oxygen, as for example perowskites, delafossites, spinels, bronzes, are well-known. The most commonly used of said materials, such as oxides and mixed oxides, often contain at least a noble metal belonging to the group comprising platinum, iridium, rhodium, ruthenium and palladium.

These electrocatalytic properties have been exploited for providing electrocatalytic anodic coatings, essentially on valve metal substrates, typically on titanium.

Valve metals, such as titanium, zirconium, tantalum and hafnium, and the alloys thereof, while being, more than useful, indispensable for preparing anodes, cannot be used to prepare cathodes due to the fact that such metals are all more or less subject to hydridization by the atomic hydrogen which forms at the cathode.

On the other hand, several attempts have been made to apply a coating of a catalytic ceramic material, such as for example an oxide of a noble metal, onto non-valve metals, such as steel, stainless-steel, cobalt, nickel, copper and alloys thereof. However, no commercial application has been developed so far, due to the poor adhesion of the ceramic coating of the oxides to these metals.

In fact, the method for applying a coating of ceramic oxides of at least a noble metal, that is through high temperature thermal decomposition of decomposable salts of the metal or metals applied onto the surface of the substrate, does not seem suitable for coating substrates of non-valve metals.

These metals, such as, for example, nickel, copper, iron and in general steels, unlike valve metals, are subject to deep oxidation during the process of thermal decomposition in an oxygen atmosphere such as air. Further, said oxides are not compatible and generally are nonmixable with the catalytic ceramic oxide or oxides. Such lack of affinity is one of the main causes of the poor adhesion of the catalytic coating. In addition, differently from the oxides of the valve metals, the oxides of the metal substrate scarcely adhere to the surface of the parent metal.

The lack of primary adhesion, that is at the time of preparation of the electrode, is not the only source of problems. The oxides of many base non-valve metals are often unstable, being subject to reduction or oxidation phenomena under particular conditions. Moreover, unlike the cited catalytic ceramic materials, these oxides act often as insulators, in the sense that they have negligible electric conductivity.

Even when sufficient primary adhesion is obtained, for example, by roughening the surface of the metallic substrate either mechanically and/or by pickling, or also by forming the catalytic ceramic coating onto a surface of particular metal substrates, such as, for example, porous layers obtained by plasma-jet depositions, leaching or similar techniques, the incompatibility between the metal constituting the substrate and its oxide and the catalytic ceramic material may give rise to rapid degradation of the electrode during operation. This in turn, leads to a progressive detaching and loss of the catalytic ceramic material and a consequent increase of the electrode overvoltage during operation in the electrolysis cell.

In particular, the violent evolution of gas, for example gaseous hydrogen, which takes place during electrolysis, within the interstices and pores of the catalytic coating tends to detach the catalytic coating after a very short and commercially unacceptable period of time.

In view of this difficulty, commercial cathodic catalytic coatings are based on catalytic materials different from the materials utilized for the thermally formed ceramic oxides. Usually, for preparing said coatings, materials which may be applied either galvanically of by plasma-jet deposition, such as "Raney" nickel, nickel sulphide, galvanically deposited noble metals or nickel or porous iron plating by plasma jet deposition or by leaching, are resorted to with the aim to increase the real active surface area of the cathode.

These coatings, although sufficiently catalytic, are readily "poisoned" by the impurities present in the electrolyte. In particular, said catalytic coatings are real catchers of the impurities, particularly iron, unavoidably present, even though in trace amounts, in the electrolyte. Consequently, after a short time, the cathodic overvoltage increases and remains stable at the excessive values typical of iron or other impurities, while an adherent coating of iron and/or iron oxides containing also heavy metals, is found to have deposited onto the cathodes.

It is an object of the present invention to provide for a method of forming a coating of electrocatalytic ceramic material onto a metallic support with improved characteristics of stability, compared with electrocatalytic coatings obtained by known techniques.

It is another object of the present invention to provide for a novel catalytic electrode exhibiting improved characteristics of durability and efficiency.

It is a further object of the present invention to provide for an improved cell for the electrolysis of alkali metal halides and particularly of sodium chloride.

It is furthermore an object of the present invention to provide an improved process for the electrolysis of alkali metal halides and particularly sodium chloride which allows the saving of electric energy consumption.

These and other objects and advantages of the present invention will become obvious from the following detailed description.

Some of the terms, which have already been introduced in the discussion of the prior art and will be used in the following description of the invention, have a well defined meaning for the expert in the art. However, for a better understanding of interpretation, wherever it should be necessary, the meaning attributed to said terms is discussed herebelow:

By "ceramic material" is intended a highly stable material having a crystal structure consisting of metal and non-metal elements. The non-metal element is commonly oxygen, although it may also be carbon, nitrogen, sulphur or a halogen, such as, for example, fluorine.

By "electrocatalytic ceramic material" or more briefly "catalytic", is intended a ceramic material which exhibits an appreciable electrical conductivity at room temperature and which presents a low overvoltage with respect to the electrochemical reaction of interest.

By "metallic support" or "metallic substrate" or "supporting metal" is intended the metallic structure forming the electrode. Said structure may have any shape. It may be a solid or perforated or expanded plate, or a rod, or any other geometric solid, or a woven or non-woven cloth made of metal wires or similar structures.

By "isomorphous" materials and "compatible" materials is intended that the materials have respectively the same, or substantially similar, crystal structure and a structure which is sufficiently compatible, so that mixed, solid-solution phases are formed.

According to the present invention, an electrode is provided, for use in electrochemical reactions, which comprises an electrically conductive inert metallic substrate and an electrocatalytic adherent coating, characterized in that said coating comprises:

(a) an anchoring pre-coating or interlayer onto at least part of the surface of the metallic substrate and including particles of ceramic material dispersed in an inert metallic matrix;

(b) a ceramic superficial coating onto said precoating, said superficial coating consisting essentially of electrocatalytic ceramic material, the ceramic material of said pre-coating substantially with or even isomorphous to the ceramic material of the superficial coating. The method of the invention for preparing said adherent coating of an electrocatalytic ceramic material onto the surface of an inert metallic support is characterized in that it comprises:

(a) forming onto said surface of the substrate an anchoring pre-coating or interlayer consisting of particles of a ceramic material dispersed in an inert metallic matrix, said ceramic material compatible or even isomorphous with the ceramic material to be utilized for forming the subsequent electrocatalytic superficial coating, said pre-coating formed by galvanic electrodeposition for a period of time sufficient to form the desired thickness of the precoating, the metal of said matrix and said particles from a plating bath containing ions of the matrix metal and wherein the particles of ceramic material are held in suspension;

(b) applying onto the surface of said anchoring precoating or interlayer a solution or dispersion of precursor compounds of the electrocatalytic ceramic material selected for forming the electrocatalytic superficial coating;

(c) removing the solvent of said solution or dispersion of precursor compounds;

(d) heating in an oven at a temperature and for a time sufficient to convert said precursor compounds into ceramic material;

(e) cooling down to room temperature;

(f) optionally, repeating steps (b), (c), (d) and (e) as many times as necessary to obtain the desired thickness as the electrocatalytic superficial coating.

It has been surprisingly found that the method of the present invention make it possible to obtain an exceptional and unexpected adherence between materials, such as, for example ruthenium oxide which is notably a very useful electrocatalytic ceramic material, and nickel, stainless steel, copper, which are particularly suitable metals for producing cathodes to be utilized in electrolytic cells.

It has also been found that, according to the method of the present invention, electrocatalytic ceramic coatings are provided which are exceptionally durable and resistant to poisoning due to the impurities normally contained in the electrolyte.

Comparative tests have been carried out, by subjecting sample electrodes to accelerated aging, to verify the adhesion and durability of the coatings obtained by the method of the present invention. The results of said tests show that the active lifetime of the coatings of the present invention is from three to eight times longer than that of conventional coatings.

This outstanding stability may be explained by the fact that particles of the ceramic material, intimately incorporated and embedded into the inert metallic matrix, when substantially compatible or even isomorphous with the superficial catalytic ceramic material, constitute as many anchoring points to said superficial coating.

It may be also assumed that formation of the superficial coating begins preferentially on the compatible or even isomorphous particles present on the surface of the anchoring pre-coating or interlayer, which would act as preferential points of nucleation and growth of said superficial catalytic ceramic material during its formation by thermal decomposition of the precursor compounds.

Another advantage is represented by the fact that the characteristics of adherence and durability of the catalytic ceramic coating according to the present invention do not seem to decrease either when said coatings are formed onto substantially rigid metallic structures as well as when the same coatings are formed onto extremely flexible metallic structures, such as, for example, a woven fabric made of 0.1 mm nickel wire. That is, while catalytic ceramic coatings prepared according to the conventional technique result extremely rigid and brittle and therefore cannot be applied on thin, flexible metal structures as they would readily come off while flexing the substrate, the catalytic ceramic coatings prepared according to the present invention are not subject to fractures or detaching even when applied to extremely thin and flexible structures.

In addition, when the particles of ceramic material intimately embedded in the inert metallic matrix of the anchoring pre-coating or interlayer, according to a preferred embodiment of the present invention are constituted by a conductive ceramic material, they constitute preferential "bridges" for the passage of electric current between the electrocatalytic ceramic material of the superficial coating and the metallic matrix of the anchoring pre-coating and thence of the metallic supporting structure.

In other words, the ceramic particles contained in the pre-coating or interlayer, besides enhancing the mechanical stability of the superficial catalytic ceramic coating, by forming, onto the surface of the anchoring pre-coating or interlayer, areas of nucleation and growth of the ceramic material constituting the superficial coating, greatly reduce the ohmic resistance which hinders the electrons transfer from the surface of the electrode to the supporting metal structure and vice versa.

Some practical examples, which describe preferred methods and conditions to accomplish the present invention, are hereinbelow described with the only purpose to better illustrate the invention and are not intended to limit the scope of the same, which obviously may be achieved and utilized in different ways.

In consideration of the outstanding utility of the present invention for preparing cathodes for electrolytic cells, particularly advantageous in the electrolysis of sodium chloride to produce chlorine and caustic soda, the foregoing description makes reference to the conditions and materials which are preferred for said application.

A cathode to be utilized in chlor-alkali electrolysis cells provided with ion exchange membranes or porous diaphragms, is generally based on a mesh, or expanded metal or foraminous sheets of iron, nickel, nickel alloy, stainless steel, copper or silver. These materials are resistant to hydrogen embrittlement and are substantially resistant to corrosion also under shut-down of the electrolytic cell.

The mentioned metal substrates may be subjected to degreasing, sand-blasting and/or acid pickling, according to conventional procedures, in order to make the surfaces thereof more receptive to the coating.

According to a preferred embodiment of the present invention, the inert metallic substrate is cathodically polarized in a plating bath wherein at least one salt of the matrix metal and powder of a catalytic ceramic material, preferably conductive, are dissolved and held in suspension by stirring. A suitable metal for the matrix of the galvanically deposited anchoring precoating or interlayer has to be corrosion resistant and easily platable by galvanic deposition. Suitable materials are iron, nickel, silver, copper, chromium, and alloys thereof. However the preferred metals are nickel and silver, due to the higher resistance to corrosion and ease of electrodeposition.

Usually, inorganic salts of said metals, such as chlorides, nitrates and sulphates, are used for the plating bath. It is furthermore possible to use one or more salts of the same metal or of different metals in the plating bath. In this latter case a matrix is deposited, which is in fact a metal alloy of one or more of the above metals.

The ceramic material constituting the particles in suspension in the plating bath is selected taking into account the type of catalytic ceramic material to be formed onto the anchoring pre-coating or interlayer. The ceramic material constituting the galvanically codeposited particles embedded in the inert metallic matrix of the anchoring pre-coating or interlayer should preferably exhibit affinity and be substantially compatible or even isomorphous with the catalytic ceramic material constituting the superficial coating.

Preferably, though not necessarily, the ceramic material constituting the particles of the inert metallic matrix should be the same as the superficial coating.

Particularly suitable ceramic materials are the oxides and mixed oxides of at least one metal belonging to the group comprising titanium, zirconium, niobium, hafnium, tantalum, ruthenium, iridium, platinum, palladium, rhodium, cobalt, tin and manganese. Perovskites, delafossites, spinels; also borides, nitrides, carbides and sulphides are also useful materials.

Mixed oxides of titanium and ruthenium, of tantalum and iridium, of zirconium and iridium or of titanium and iridium, the non-stoichiometric conductive oxide of titanium, titanium boride, titanium carbide, are particularly preferred because they exhibit both an exceptional stability and a good electrical conductivity.

The diameter of the particles is preferably comprised between 0.2 and 30 micrometers, and generally is less than the thickness of the matrix metal to be deposited. Particles having a diameter lower than 0.1 micrometers give rise to agglomeration and uneven dispersion in the inert metallic matrix, unless surfactants are added to the plating bath. Particles having a diameter higher than about 30 micrometers cause an excessive roughness and uneveness of the anchoring surface.

The amount of ceramic material particles contained in the plating bath may vary within ample limits. The preferred value is generally comprises between 1 and 50 grams of powder for each liter of solution, providing for stirring the plating bath in order to prevent sedimentation.

The current density, temperature and pH of the plating bath will be those recommended by the supplier or those determined in order to obtain a satisfactory adhesion to the substrate.

Deposition of the metallic coating, containing the ceramic particles dispersed in the inert metallic matrix, is then carried out until a coating having a uniform thickness comprised between 2 and 30 or more micrometers is produced, this thickness being generally greater than the average particle diameter. A thickness of at least 2 micrometers may be considered as the minimum necessary to ensure uniform covering of the entire surface, while no particular advantage has been observed by depositing a coating more than 30 micrometers thick, although this does not involve any particular problem apart from the proportionally higher cost of the anchoring pre-coating or interlayer.

In the case of nickel substrates being utilized, the thickness of the anchoring pre-coating should be preferably comprised between 5 and 150 micrometers, while in the case of copper, iron or stainless steel substrates, the thickness should be preferably increased up to 10 to 30 micrometers in order to improve the resistance to corrosion of these substrates under particularly severe and accidental conditions, such as a high concentration of hypochlorite in the electrolyte.

At the scanning electron microscope, the substrates appear coated by an adherent pre-coating containing ceramic particles uniformly dispersed in the inert metallic matrix. The amount of ceramic material contained in the inert metallic matrix appears to be comprised between 3 and 15 percent by weight. The surface of the pre-coating appears as a mosaic of ceramic material particles set on the inert metallic matrix. The surface of the metal comprised between the ceramic particles often presents a dendritic morphology. Large numbers of pores and cavities are found.

After washing and drying of the pre-coated substrates, a solution or dispersion of one or more precursor compounds of the electrocatalytic ceramic material is applied onto the surface of said pre-coated substrates. After drying to remove the solvent, the pre-coated substrates are then heated in an oven at a temperature sufficient to decompose the precursor compound or compounds and to form the superficial ceramic electrocatalytic coating.

The above application sequenced, drying and heating in an oven, may be repeated as many times until the desired thickness of the superficial ceramic coating is obtained.

In the case of oxides and mixed oxides, heating should preferably take place in the presence of oxygen.

Suitable precursor compounds may be inorganic salts of the metal or of the metals forming the electrocatalytic ceramic material, such as, for example, chlorides, nitrates and sulphates or organic compounds of the same metals, such as for example, resinates, alcoholates and the like.

The preferred metal belongs to the group comprising ruthenium, iridium, platinum, rhodium, palladium, titanium, tantalum, zirconium, hafnium, cobalt, tin, manganese, lanthanum and ittrium.

The temperature in an oven during the heating treatment is generally comprised between 300° C. and 650° C. Under this range of temperatures, a complete conversion of the precursor compounds into ceramic material is achieved.

The amount of electrocatalytic ceramic material of the superficial coating should preferably correspond to at least 2 grams per square meter of external area covered by said coating. By increasing the amount of the ceramic material of the superficial coating up to about 20 grams per square meter, a noticeable proportional increase of the durability has been observed, while further thickening of the superficial coating does not seem to be particularly advantageous in this regard. Thus the amount of ceramic material of the superficial coating preferably is 2–20 grams thereof per square meter of coated surface rarely being below 2 gram or above 20 grams per square meter.

A particularly preferred material is ruthenium oxide, which is highly catalytic for hydrogen evolution and the least expensive among noble metals; however quite satisfactory results have been obtained also with iridium, platinum, rhodium and palladium.

In particular, ruthenium and titanium mixed oxide in a weight ratio between the metals in the range of 10:1 to 1:1 by weight is most preferred both for the particles dispersed in the metallic matrix of the anchoring pre-coating or interlayer and for the superficial catalytic coating. The presence of titanium oxide makes the coating chemically and mechanically more resistant than ruthenium oxide alone.

The solution of the decomposable salts may be aqueous, in which case inorganic salts of the metals, such as chlorides, nitrates or sulphates, are preferably used, providing for acidifying the solution to such an extent as to properly dissolve the salts and adding small quantities of isopropyl alcohol.

Otherwise, organic solutions of decomposable organic salts of the metals may be used.

The salts of the metals in the coating solution are proportioned depending on the desired ratio between the metals in the oxide mixture obtained by calcination.

The following examples are reported only for a more detailed illustration of the invention. Obviously, only some particularly significant practical examples are reported and the invention is not intended to be limited by said specific embodiments. Unless differently indicated, the ratios, percentages and parts are to be intended as referred to weight.

EXAMPLE 1

Several mesh samples made of a nickel wire having a diameter of 0.1 millimeters were steam-degreased and rinsed in a solution containing 15 percent hydrochloric acid, for about 60 seconds. Said nickel mesh samples were utilized as substrates for the electrodeposition from a plating bath having the following composition:

| | |
|---|---|
| nickel sulphate | 200 g/l |
| nickel chloride | 50 g/l |
| boric acid | 40 g/l |
| ruthenium-titanium mixed oxide powder with a ratio between the metals of 10:1 | 10 g/l |

The bath had a temperature of about 50° C., a current density of 50 milliamperes per square centimeter, the mixed oxide powder particles had an average diameter of about 2 micrometers. A minimum diameter being 0.5 micrometers and the maximum diameter 5 micrometers.

The powder was held in suspension in the bath by mechanical stirring and electrodeposition lasted for about 20 minutes.

The thickness of the applied anchoring pre-coating was about 15 micrometers and about 10 percent of the coating consisted of mixed oxide particles evenly dispersed over the nickel matrix.

Particles of the mixed oxide on the pre-coating surface were only partially covered by nickel. Thus some portion of the surface comprised particles with uncoated or exposed surfaces. The nickel coating itself appeared dendritic.

After rinsing in deionized water and drying, onto the surface of one of the coated samples, an aqueous solution having the following composition:

| | | |
|---|---|---|
| ruthenium chloride | (as metal) | 10 g |
| titanium chloride | (as metal) | 1 g |
| aqueous solution of 30% hydrogen peroxide | | 50 cc |
| aqueous solution of 20% hydrochloric acid | | 150 cc |

was applied.

After drying at 60° C. for about 10 minutes, the sample was heated in an oven in the presence of air at 480°

C. for 10 minutes and then allowed to cool down to room temperature.

Under microscopic scanning, a superficial or surface oxide coating appeared to have formed, which, upon X-rays diffraction, was found to be a solid solution of ruthenium and titanium oxide.

The superficial oxide coating thickness was about 2 micrometers and the quantity, determined by weighing, was about 4 grams per square meter of coated surface.

On other samples, coated by the anchoring pre-coating or interlayer applied by electrodeposition, the process of forming the superficial mixed oxide coating was repeated three times, thus forming a ceramic superficial coating of about 12 grams per square meter.

The electrodes thus prepared have been tested as cathodes for hydrogen evolution in 35% caustic soda (NaOH) at 80° C. and under current densitity varying from 500 l A/m2 to 5000 A/m2. A Tafel diagram has been prepared for each sample. For comparison purposes, a sample coated only by the anchoring pre-coating or interlayer applied by electrodeposition has been tested as cathode under the same conditions.

The electrode coated by 12 g/m2 oxide exhibited a voltage versus reference calomel electrode of −1.175 V (SCE) at 500 A/m2 and a Tafel slope of about 35 mV/decade of current.

The electrode having a superficial coating of only 4 g/square meter exhibited a voltage, versus a reference calomel electrode, of −1.180 V (SCE) at 500 A/m2 and a Tafel slope of 35 mV/decade of current.

The comparison electrode, without the superficial oxide coating, exhibited a voltage versus a reference calomel electrode of −1.205 V(SCE) at 500 A/square meter and a Tafel slope of about 85 mV/decade of current.

For comparison purpose, the ruthenium-titanium mixed oxide ceramic coating has been applied onto a nickel wire mesh similar to the one utilized for preparing the electrodes of the present invention, without previously applying the galvanic pre-coating or interlayer onto the substrate. An oxide coating of about 6 g/m2 was formed.

Said electrode, tested under the same conditions, exhibited a voltage, versus a reference calomel electrode, of −1.185 V(SCE) at 500 A/m2 and a Tafel slope of about 50 mV/decade of current.

Although the catalytic activity resulted almost similar to that of the electrodes according to the present invention, a very scarce adherence was detected. In fact a vigorous shaking against a tough surface was sufficient to cause removal of appreciable quantities of ceramic material.

Conversely, the superficial coating of the electrode according to the present invention was perfectly adherent and resisted to a peeling-off test by means of adhesive tape.

EXAMPLE 2

Electrodes were prepared according to the same procedure described in Example 1 but utilizing different materials.

The following Table 1 reports the results obtained with the various electrodes under the same test conditions of Example 1.

TABLE I

| Substrate | Anchoring pre-coating (thickness 15 micrometers) | Ceramic superficial coating (15 g/m2) | Cathode Voltage 500 A/m2 V (SCE) | Tafel slope mV/decade of current |
|---|---|---|---|---|
| Nickel | Ni + RuO2/TiO2 | RuO2/TiO2 | −1.175 | 35 |
| Nickel | Ni + RuO2 | RuO2 | −1.170 | 37 |
| Nickel | Ag + RuO2 | RuO2 | −1.170 | 35 |
| Nickel | Ni/Ag + RuO2 | RuO2 | −1.178 | 35 |
| Nickel | Ni + TiO2 | RuO2 | −1.170 | 40 |
| Nickel | Cr + IrO2 | IrO2 | −1.180 | 42 |
| Iron | Fe + RuO2 | RuO2 | −1.175 | 38 |
| Copper | Cu + TiO2 | RuO2/TiO2 | −1.175 | 40 |
| Silver | Ag + TiO2 | RuO2/TiO2 | −1.170 | 38 |

EXAMPLE 3

The electrodes of Example 2 were utilized as cathodes in laboratory electrolysis cells provided with Nafion(R) cation exchange membranes, produced by E. I. Du Pont de Nemours, and titanium anodes coated by a coating of mixed oxide of ruthenium and titanium.

An aqueous solution of 200 g/l sodium chloride was fed to the anodic compartment of the electrolysis cell and deionized water was fed to the cathodic compartment, the NaOH concentration being maintained at about 35%. Current density was about 3000 A/m2 and the operating temperature in the range of 85° to 95° C.

In the first reference cell, the cathode was made of nickel and untreated, while in a second reference cell the cathode was made of nickel coated only by the anchoring pre-coating or interlayer, which consisted of a nickel matrix containing 12% of ruthenium oxide particles.

The cell voltage detected in the cells provided with the cathodes prepared according to the present invention was about 0.2 V lower than in the first reference cell and about 0.06 V lower than in the second reference cell.

After 3000 hours of operation, the cell voltage in the cells equipped with the cathode of the present invention resulted substantially unchanged, the difference versus the first reference cell had decreased to about 0.12 V, while versus the second reference cell had increased to about 0.1 V. The cathodes according to the present invention appeared unvaried, while the untreated nickel cathode as well as the nickel cathode coated only by the nickel pre-coating or interlayer, galvanically applied, appeared covered by a black precipitate which, upon analysis, resulted to be composed of iron and iron oxide.

I claim:

1. An electrode for use in electrochemical reactions comprising an electrically conductive inert metallic substrate and an electrocatalytic adherent coating, characterized in that said coating comprises:

(a) an anchoring pre-coating or interlayer onto at least part of the surface of the metallic substrate and including particles of ceramic material dispersed in an inert metallic matrix;

(b) a ceramic superficial coating onto said pre-coating, said superficial coating consisting essentially of electrocatalytic ceramic material, the ceramic material of said pre-coating substantially compatible or even isomorphous to the ceramic material of the superficial coating.

2. The electrode of claim 1, characterized in that the inert metallic substrate is constituted by a metal selected from the group of iron, nickel, stainless steel, copper, cobalt, silver and alloys thereof.

3. The electrode of claim 1, characterized in that the inert metallic matrix of the anchoring pre-coating or interlayer is constituted by a metal selected from the group of iron, nickel, silver, copper, cobalt, chromium and alloys thereof.

4. The electrode of claim 1, characterized in that the ceramic material particles of the anchoring pre-coating or interlayer are made of an oxide or a mixed oxide of at least one metal selected from the group of titanium, zirconium, hafnium, ruthenium, iridium, platinum, palladium, rhodium, cobalt, tin and manganese.

5. The electrode of claim 1 characterized in that the electrocatalytic ceramic material of the superficial coating is constituted by an oxide or mixed oxide of at least one metal selected from the group of ruthenium, iridium, platinum, palladium, rhodium, cobalt and tin.

6. The electrode of claim 1, characterized in that the anchoring pre-coating or interlayer, has a thickness comprised between 5 and 30 micrometers and the electrocatalytic superficial coating is in the range of 2 to 20 grams per square meter.

7. Electrolysis cell for the production of halogen and alkali metal hydroxide from an aqueous solution of alkali metal halide, comprising at least an anode and at least a cathode separated by a diaphragm or an ion-exchange membrane, characterized in that the cathode is a metal structure essentially comprising:

(a) an inert metallic substrate selected between nickel, nickel alloys and stainless steel;

(b) an anchoring pre-coating or interlayer galvanically deposited onto the surface of the metallic substrate and consisting of particles of an oxide containing at least a noble metal, dispersed in an inert metallic matrix metal selected between nickel, silver and alloys thereof;

(c) a superficial coating of a catalytic oxide containing at least a noble metal, formed by thermal decomposition of a decomposable salt, onto the surface of the anchoring pre-coating.

8. The cell of claim 7, characterized in that the anchoring pre-coating is constituted by nickel containing particles of ruthenium oxide.

9. The cell of claim 7, characterized in that the ceramic superficial coating is constituted by a mixed oxide of ruthenium and titanium in a weight ratio between the metals comprised between 10:1 and 1:1.

10. In an electrolysis cell for the production of chlorine and caustic soda, comprising an anode and a cathode separated by an ion exchange membrane, the improvement characterized in that said cell comprises utilizing as a cathode an electrode constituted by a nickel substrate coated by an anchoring pre-coating or interlayer consisting of ceramic material particles dispersed into a matrix made of nickel or nickel alloys, obtained by galvanic deposition, and an electrocatalytic superficial coating made of a ceramic material, obtained by thermal decomposition of precursor compounds onto the surface of said anchoring pre-coating or interlayer, the ceramic material constituting said particles dispersed in the anchoring pre-coating or interlayer being substantially compatible or even isomorphous to the ceramic material of said electrocatalytic superficial coating.

* * * * *